United States Patent [19]

Noack

[11] 4,315,394

[45] Feb. 16, 1982

[54] WRAP-AROUND PACKAGING MACHINE

[75] Inventor: Fritz Noack, Ottobeuren, Fed. Rep. of Germany

[73] Assignee: Emil Pester GmbH Verpackungsmaschinen, Wolfertschwenden, Fed. Rep. of Germany

[21] Appl. No.: 793,894

[22] Filed: May 4, 1977

[30] Foreign Application Priority Data

May 28, 1976 [DE] Fed. Rep. of Germany ..... 2623907

[51] Int. Cl.[3] ..... B65B 11/08; B65B 13/02

[52] U.S. Cl. ..... 53/553; 53/229; 53/586

[58] Field of Search ..... 53/198 R, 182 R, 228, 53/229, 553, 586; 74/89.22, 89.21; 100/29, 32; 92/137, 85 R

[56] References Cited

U.S. PATENT DOCUMENTS

| | | | |
|---|---|---|---|
| 181,052 | 8/1876 | De Grey | 100/29 |
| 2,606,761 | 8/1952 | Group | 92/137 X |
| 2,613,915 | 10/1952 | Stone | 92/137 X |
| 2,668,450 | 2/1954 | Crookston | 92/137 X |
| 2,722,102 | 11/1955 | Pilch | 92/137 |
| 2,920,553 | 1/1960 | Van Merle | 100/27 |
| 3,332,207 | 7/1967 | Midnight | 53/207 |
| 3,464,317 | 9/1969 | Woodward | 92/137 X |
| 3,470,814 | 10/1969 | Tschappu | 53/198 R |
| 3,512,454 | 5/1970 | Perkins | 92/85 R X |
| 3,530,554 | 9/1970 | Whitehurst | 74/89.21 |
| 3,946,539 | 3/1976 | Noack et al. | 53/198 R |
| 3,955,339 | 5/1976 | Kiener et al. | 53/228 X |

FOREIGN PATENT DOCUMENTS

| | | | |
|---|---|---|---|
| 787611 | 12/1957 | United Kingdom | 74/89.22 |
| 1279671 | 6/1972 | United Kingdom | 53/198 R |

*Primary Examiner*—John Sipos
*Attorney, Agent, or Firm*—Alfred H. Hemingway, Jr.; Steven H. Bazerman

[57] ABSTRACT

In a wrap-around packaging machine by means of which a film loop is wrapped around a plurality of objects, the film passes through a slit provided in a rotary tensioning roller at an end of which a driving pulley is fastened. A rope is wound around the driving pulley. One end of the rope is connected to a traction device and the other end is connected to a restoring device. The tensioning roller by the operation of the traction device can be rotated from a first defined position in which the film freely passes through the slit of the tensioning roller into a second position in which the film is clamped at the tensioning roller and the film loop is tensioned. Then after welding or heat sealing of the film loop the traction device is made inoperative and the restoring device operates in order to move back the tensioning roller into its defined first position.

1 Claim, 5 Drawing Figures

WRAP-AROUND PACKAGING MACHINE

The invention relates to a wrap-around packaging machine by means of which a film loop is wrapped around several objects, tensioned, welded and severed from the rest of the film.

In a known wrap-around packaging machine, tensioning is effected by a gripper between the jaws of which the film coming from the film loop can be temporarily clamped, whereupon the gripper is moved linearly. Thus clamping and tensioning require separate drives (german application laid open to public inspection DT-OS No. 23 50 828).

The invention is characterized by a rotary tensioning roller with a nondeformable slit through which the film strip adjacent to the film loop passes freely and with a driving pulley fastened to the front end of the tensioning roller, a rope or suchlike wound around said driving pulley being acted upon by a traction device and a restoring device.

The invention has the advantage that a single simple drive is sufficient for about half a revolution of the tensioning roller to clamp the film temporarily and subsequently to tension the film loop. The tensioning operation is controlled in a tension dependent manner, i.e the drive is stopped when a predetermined tension of the film loop is reached. Then the bonding of the two overlapping film strips takes place by welding or heat sealing, followed by severing. At the same time the tensioning roller is turned back very quickly to its initial position.

It is essential that the top of the tensioning roller should be about flush with the plane of a feed table for the objects to be wrapped and that it should be arranged in close proximity to the welding zone. Owing to the small size of the tensioning roller, the latter can be arranged very closely to the closed film loop.

The traction device is preferably a compressed air cylinder which can be adjusted to a predetermined tractive force by means of a controlling valve. The restoring force is preferably provided by a tension spring which acts on the other end of the rope. Owing to the use of a flexible driving means, such as a belt, a chain or a rope, the traction device and the restoring device can be arranged in the machine so as to ensure easy accessibility for servicing.

The invention will be described in more detail with reference to some embodiments represented in the drawings.

Figure 1:
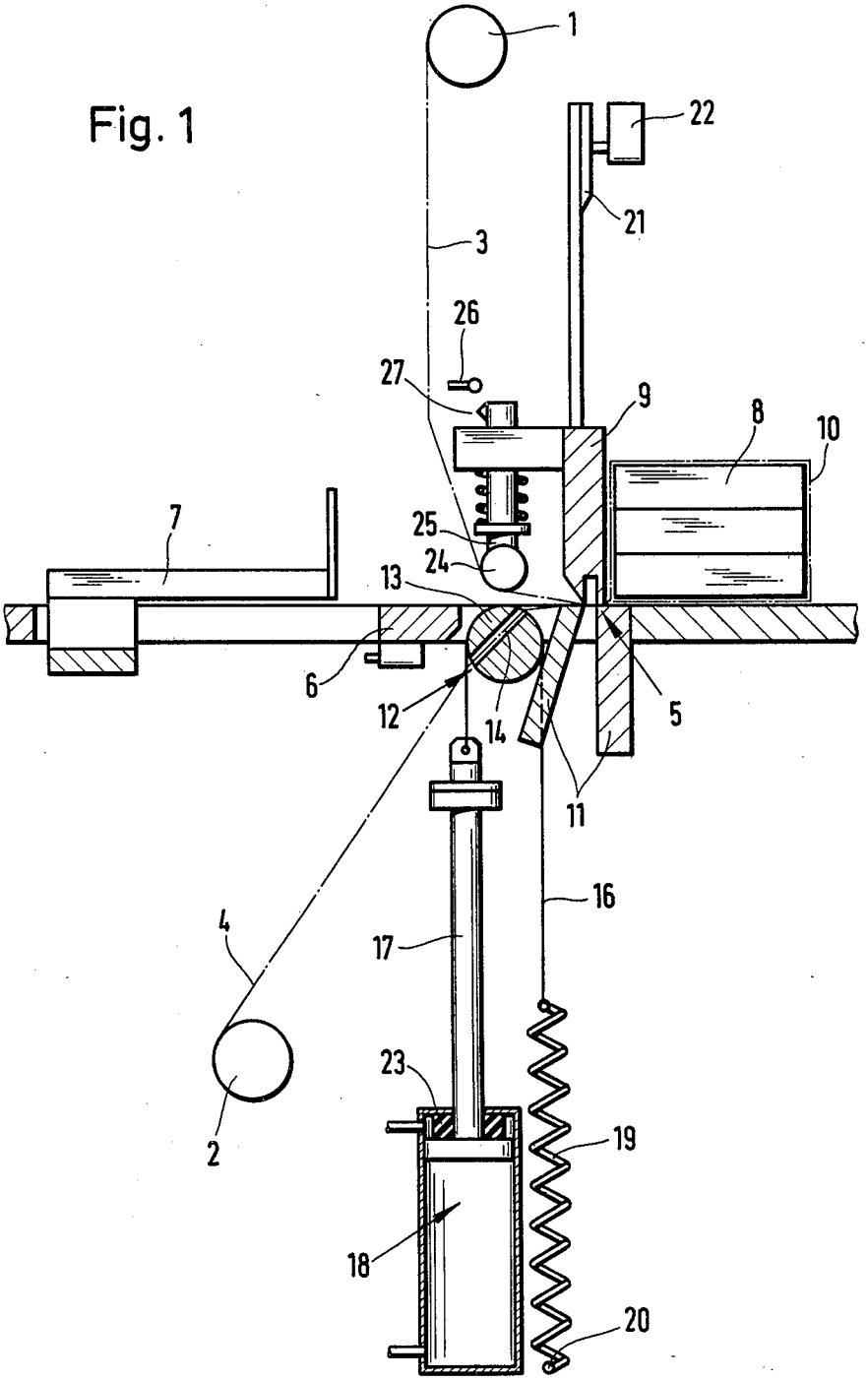
FIG. 1 is a diagrammatic sectional view of a wrap-around packaging machine.

Film strips 3 and 4 are drawn off an upper film supply roll 1 and a lower film supply roll 2 respectively and welded together in the region of a clamping device 5, whereby the film strips 3 and 4 form a film curtain which passes through a slit in the feed table 6. On this feed table objects 8 which are to be packaged are pushed against the film curtain 3, 4 by means of a slide 7, while the movable clamping beam 9 of the clamping device 5 is still in its raised position (not shown). The objects 8 are pushed along under the clamping beam 9 so that the film 2, 3 forms a loop 10. As soon as the objects 8 have passed beyond the clamping device 5, the movable clamping beam 9 travels downwards in order to clamp the films 3, 4 between the upper clamping beam 9 and the lower two-piece clamping beam 11. However, before this clamping takes place, a tensioning device 12 comes into operation and tightens the film loop 10 wrapped around the objects 8.

The tensioning device 12 consists of a slit roller 13 with a slit 14 which is arranged eccentrically and extends along most of the axial length of the roller 13. The lower film strip 4 is passed through the slit 14, the initial position of which is selected so that the film strip 4 can be passed through it with as little friction as possible when the objects 8 are pushed in the wrap-around position. At one end of the slit roller 13 there is a sprocket wheel 15 (FIG. 2) peripherally engaged by a chain 16, one end of which is fastened to the piston rod 17 of the pneumatically operated piston-and-cylinder arrangement 18, while the other end is fastened to a tension spring 19, the free end of which is anchored to the frame of the machine.

On the movable clamping beam 9 there is mounted a vertically adjustable cam surface 21 which co-operates with a switch 22 when moving downwards in order to admit compressed air to the cylinder 18 via a pressure-reducing valve (not shown). This causes the piston rod 17 to sink into the cylinder, whereby the chain 16 turns the slit roller 13 counter-clockwise. After the roller 13 has turned through a certain angle, the film 4 gets firmly clamped in the slit 14 of the roller and the further rotation of the roller brings about the desired tensioning of the film loop 10. As soon as the desired tension, which can be preset by means of the adjustable pressure-reducing valve, is reached, the motion of the piston rod 17 is stopped. Owing to the location of the slit roller in close proximity to the clamping zone, tensioning requires only about half a revolution of the slit roller for hard packages, while for soft packages a full revolution of the roller or a little more is necessary. The time required for this to occur is short, actually short enough for the tensioning operation to be completed before the clamping beam 9 reaches its clamping position. As soon as this has happened, the stress on the films is relieved by a reversal of the compressed air control of the cylinder 18. The spring 19 effects a nearly instant return of the roller 13 to its initial position. However, to ensure a soft impact, a shock absorber 23 is provided for the piston in the cylinder 18.

The upper film strip 3 is guided around a deflecting roll 24 mounted on a spring-operated safety member 25 of the upper clamping beam 9. When the roller 24 strikes an obstacle, a trigger cam 27 actuates a switch 26 located on the clamping beam 9, bringing about the immediate reversal of the motion of the clamping beam 9.

Figure 2:
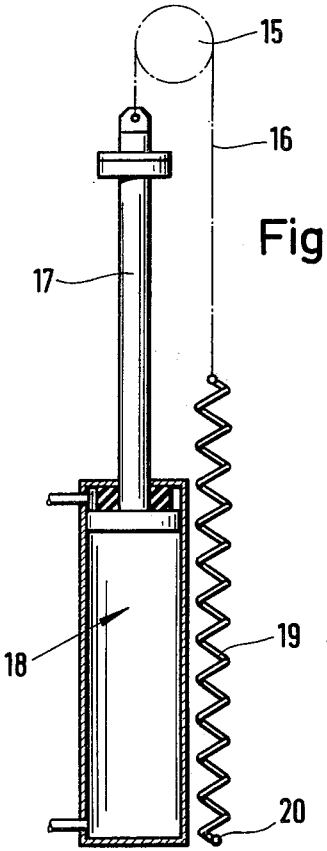

FIG. 2 corresponds to the arrangement according to FIG. 1.

Figure 3:
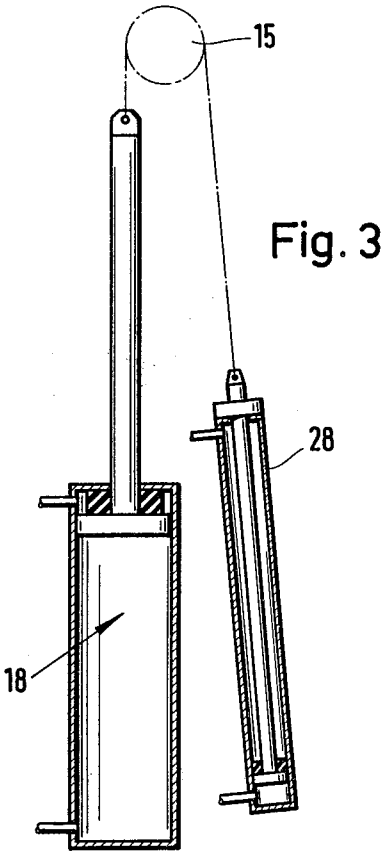

According to FIG. 3, the restoring device for the roller consists of a pneumatic cylinder 28 which is kept under slight pressure on the side of the piston rod. During the traction performed by the cylinder 18, the air is briefly compressed in the restoring cylinder 28, but only up to a preset pressure, whereupon a relief valve operates and allows excess air to escape. The back pressure is thus kept constant, so that the same restoring force acts in every operating position of the traction cylinder 18. For longer traction paths, the arrangement according to FIG. 3 is therefore superior to that shown in FIG. 2.

Figure 4:
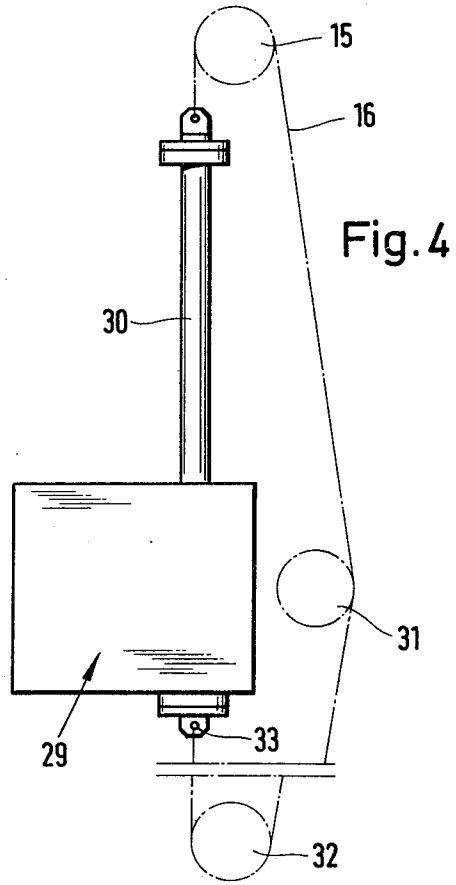
FIGS. 2 to 5 are views of various drive arrangements for the tensioning roller.

According to FIG. 4 the traction device and the restoring device are constituted by an electric linear motor 29. The linearly movable positioning member 30 of the motor is fastened to one end of the driving chain 16 which is guided via the sprocket wheel 15 of the slit roller 13 and further deflecting sprockets 31, 32 to the opposite end of the movable positioning member 30 where it is fastened at 33. When using a linear motor, a definite tractive force can be preset. The positioning member moves linearly until the preset tractive stress is reached, whereupon the positioning member and thereby also the slit roller are restored to their initial positions.

Figure 5:
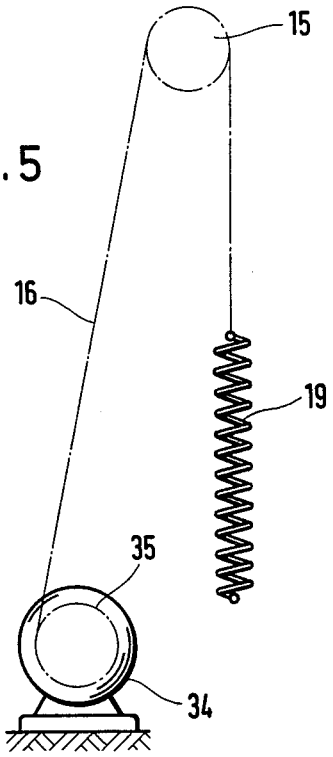

FIG. 5 differs from FIG. 2 only in that, instead of a piston moving in a compressed air cylinder, a power-controlled rotary motor 34 with a driving pulley 35 mounted on the shaft is provided for the rope 16. The rotary motor 34 can be driven electrically or by means of a pressure medium.

The claims defining the invention are as follows:

I claim:

1. An improved tensioning device for use in a packaging machine for wrapping objects with a film, the packaging machine being formed by: a table for feeding objects, an upper supply roller and cooperating lower supply roller respectively above and below said feed table, a film wrapping curtain formed between said supply rollers and passing through a slit in said feed table; slide means movably arranged on said feed table for pushing said objects against said film curtain to form a film loop encasing said objects; two clamping elements mounted on either side of said feed table, one of said two clamping elements being movable into a clamping position in which two overlapping portions of said film adjacent said film loop are gripped between said two clamping elements; means for joining the two overlapping film portions by welding in a weld zone; separating means for separating the film wrapping thus formed from the rest of the film; the improvement comprising: providing a single tension roller for drawing the film loop taut around the objects, said tension roller having a top surface flush with the plane of the feed table and being arranged between said lower supply roller and the film loop, said tension roller is disposed in close proximity to the film loop at the surface of the table and is further defined by an axial slit extending along most of the axial length of the tension roller below the plane of the feed table and permanently traversed by the film immediately adjacent the film loop; the tension roller being movable to a first position to allow said slit to extend substantially in a direction of film travel enabling said film to pass substantially without obstruction from said lower supply roller through the slit to the film loop; a driving pulley affixed to the front end of the tension roller; a rope wound around said driving pulley, a first end of which being connected with a compressed-air cylinder provided with an adjustable valve for rotating said tension roller from said first position into a second position, whereby the film loop is tensioned in direct relation to the angular movement of said slit in response to rotation of said roller, and, tensioning occurs before the film portions are clamped, the second end of the rope being connected to a mechanical spring for rotating the tension roller in an opposite direction through the same rotation angle for returning said tension roller into said first position.

* * * * *